US006648346B2

(12) United States Patent
Borel

(10) Patent No.: US 6,648,346 B2
(45) Date of Patent: Nov. 18, 2003

(54) FRAME FOR A SPORT ARTICLE

(75) Inventor: René Borel, Saint-Sylvestre (FR)

(73) Assignee: Salomon S.A., Metz-Tessy (FR)

( * ) Notice: Subject to any disclaimer, the term of this patent is extended or adjusted under 35 U.S.C. 154(b) by 25 days.

(21) Appl. No.: 09/779,843

(22) Filed: Feb. 9, 2001

(65) Prior Publication Data

US 2001/0013695 A1 Aug. 16, 2001

(30) Foreign Application Priority Data

Feb. 11, 2000 (FR) ..... 00 01868

(51) Int. Cl.[7] ..... A63C 1/02
(52) U.S. Cl. ..... 280/11.3; 280/11.26; 280/11.231
(58) Field of Search ..... 280/11.27, 11.15, 280/11.19, 11.221, 11.224, 11.231, 11.233, 11.25, 11.3, 7.12, 7.13, 11.16, 11.26

(56) References Cited

U.S. PATENT DOCUMENTS

| | | | | |
|---|---|---|---|---|
| 4,328,627 A | | 5/1982 | Sanders | 36/115 |
| 5,452,907 A | | 9/1995 | Meibock et al. | 280/11.22 |
| 5,505,477 A | | 4/1996 | Turner et al. | 280/613 |
| 5,549,309 A | * | 8/1996 | Gleichmann | |
| 5,720,488 A | | 2/1998 | Foffano et al. | 280/11.22 |
| 5,992,861 A | | 11/1999 | Piotrowski | 280/7.14 |
| 6,113,123 A | | 9/2000 | Cabanis et al. | 280/341 |
| 6,340,164 B1 | * | 1/2002 | Borel | 280/11.224 X |
| 6,425,587 B1 | * | 7/2002 | Moon | 280/11.21 X |
| 2001/0006281 A1 | * | 7/2001 | Gorza et al. | |
| 2001/0026054 A1 | * | 10/2001 | Olson et al. | |
| 2002/0017764 A1 | * | 2/2002 | Svensson et al. | |

FOREIGN PATENT DOCUMENTS

| | | |
|---|---|---|
| CH | 602148 | 7/1978 |
| DE | 9419948 | 4/1995 |
| EP | 0858821 | 8/1998 |
| NL | 1008323 | 6/1998 |
| WO | WO 95/03101 | 2/1995 |

* cited by examiner

*Primary Examiner*—Brian L. Johnson
*Assistant Examiner*—Bryan Fischmann
(74) *Attorney, Agent, or Firm*—Greenblum & Bernstein, P.L.C.

(57) ABSTRACT

A frame for a sports article, especially a frame for a roller skate, including a front upper portion provided to receive the front portion of a boot, and a rear upper portion provided to receive the rear portion of a boot. The front upper portion and the rear upper portion are part of the same planar upper surface. The frame further includes two cylindrical holes provided to receive two fixing elements, the holes extending in the longitudinal plane of the frame and their respective axes being spaced from one another by a value E of between about 164 mm and 170 mm, more particularly equal to about 167 mm. Moreover, a substantially cylindrical cavity centered on the axis of the cylindrical hole is provided in the upper surface. The invention is also directed to a line of boots for a roller skate and to a line of frames therefor.

11 Claims, 9 Drawing Sheets

FRAME FOR A SPORT ARTICLE

BACKGROUND OF THE INVENTION

1. Field of the Invention

The present invention relates to a frame for a sports article, in particular for a roller skate, although it could also be applicable to an ice skate.

The frame includes an upper surface adapted to receive a boot and a lower portion adapted for fixing gliding element (s), the latter being a blade of an ice skate or rollers. The fixing of the boot on the frame can be obtained by various fixing elements oriented vertically and located in the longitudinal plane of the skate.

2. Description of Background and Relevant Information

Three-point fixing of a boot to a skate frame along the longitudinal axis is known. Due to the presence of three fixing points, a good distribution of the forces is obtained, and the precise positioning of the various fixing points is not critical.

However, when one prefers to set a limit to two fixing points for economical reasons, their respective positioning with respect to the skater's foot is very important.

For an optimum fixing, the rear fixing point must be substantially in the center of the heel, whereas the front fixing point must in the area of the metatarso-phalangeal bending zone. For the same model of skate, which is provided with various sizes, the distance that separates the two fixing points, called the center distance, is not constant and varies from about 140 mm to 210 mm; there is a center distance value for each size. Thus, it is not possible to mount beneath a boot a frame that was not initially provided for it. For example, a boot having a mondopoint size 31 cannot receive the small sized frame, i.e., one provided for boots having a size smaller than 24.

Furthermore, and in a completely independent manner, it is necessary to have easy access to the fixing element(s) to facilitate the mounting and dismounting of the frame without being necessary to remove the wheels.

To overcome any difficulty in this field, a solution consists of providing lateral access to the fixing element(s). This is the solution that was selected in the second embodiment shown in the document DE-94 19 948 U. Such a system is both cumbersome and expensive, and cannot be envisioned for mass production.

Another solution consists of allowing access between the wheels from beneath the frame. For a given frame size, and for a particular arrangement of the four wheels, only certain intervals are then suited to the arrangement of the fixing element(s). In general, the wheels are uniformly arranged along the frame, for all the sizes of the frame. Thus, it is impossible to select a center distance value that can guarantee the same ease in dismounting for all of the sizes, i.e., a center distance which is such that, for all the sizes of the frame, the fixing element(s) are exactly between the wheels. The problem is also to select a center distance value that is compatible with all the sizes of the boot (foot), and the fixing requirement in the zones of the heel and of the metatarso-phalangeal joint.

It is also known to provide adjustments which enable a relative fit of the frame with respect to the boot. However, such a fit can be performed correctly only by a professional, because the position of the frame and, consequently, of the wheels with respect to the boot and, therefore, of the user's foot is determinant with respect to comfort, handling, performances, and ease in skating. Thus, transverse adjusting slits are provided on certain skates, which make it possible to displace laterally at least a portion of the boot on the frame. Although such slits enable fine adjustments, they make it very difficult to correct the adjustment in the central position. Moreover, the user who, after the frame is detached from the boot, wants to attach the same frame again or replace it with another frame, will recover his/her initial setting only at the cost of a time-consuming manipulation involving successive attempts whose outcome is uncertain.

SUMMARY OF THE INVENTION

An object of the invention is therefore to overcome the aforementioned disadvantages. In particular, an object is to provide a frame which can be disassembled from and reassembled on a boot, independently of the size of the boot.

Another object of the invention is to make it possible to mount a boot for skates on another gliding apparatus, such as a snowboard or a ski.

Another object of the invention is to provide a skate having a frame that can be detached by the user, which can be reattached easily and does not require any particular technical knowledge, including the relevance of the relative positions of the boot and of the frame.

To this end, the invention provides a frame for a sports article, especially a frame for a roller skate that includes a front upper portion, provided to receive the front portion of a boot, and a rear upper portion, provided to receive the rear portion of a boot. The front upper portion and the rear upper portion of the frame each have a planar upper surface, the two upper surfaces being coplanar, and the frame including at least two cylindrical holes for receiving two fixing elements, the holes extending in the longitudinal plane of the frame and their respective axes being spaced from one another by a value E comprised between about 164 mm and 170 mm, more particularly equal to about 167 mm.

In a preferred embodiment, two upper surfaces are part of the same upper surface of the frame which extends over the entire length of the frame.

The value E, which corresponds to the center distance value when it is comprised between 164 mm and 170 mm, enables the positioning of the rear fixing beneath the heel, and the positioning of the front fixing substantially in the area of the metatarso-phalangeal bending zone, regardless of the size of the boot.

Furthermore, for frame lengths comprised between 230 mm and 280 mm, the wheels can be arranged such that, while preserving a uniform distribution of the wheels along the frame, the fixing elements are always accessible.

The invention also relates to a boot whose sole is equipped with at least two holes provided to receive fixing elements located in the longitudinal plane of the boot and spaced from one another by a value E comprised between about 164 mm and 170 mm, more particularly equal to about 167 mm.

An object of the invention is also achieved by the provision of a line of boots for skating or any other gliding sport, including at least the smallest boot and the largest boot, each of the boots including:

a planar front lower surface from which a first boss projects, a first cylindrical recess with an axis substantially perpendicular to this surface being provided in the center of the boss and being adapted to receive first fixing elements securing the boot to the gliding apparatus, a rear lower surface that is coplanar with the front lower surface, and from which a second boss projects, a second cylindrical recess with an axis substantially perpendicular to the rear lower surface, being adapted to receive second fixing elements securing the boot to the gliding apparatus, the axis of the second cylindrical recess is substantially parallel to the axis of the first recess and is spaced therefrom by a value E comprised between about 164 mm and 170 mm, more particularly equal to about 167 mm.

Furthermore, an object of the invention is achieved by the provision of a line of frames for roller skating including at least the smallest frame and the largest frame, each frame in the line including:

two parallel vertical flanges between which a plurality of in-line wheels can be positioned;

a planar front upper surface in the middle of which a first cavity is located, a first cylindrical hole whose axis is substantially perpendicular to the front upper surface is provided in the first cavity;

a rear upper surface, coplanar with the front upper surface, in the middle of which a second cavity is located, a second cylindrical hole whose axis is substantially parallel to the axis of the first cylindrical hole and spaced therefrom by a value E comprised between about 164 mm and 170 mm, more particularly equal to about 167 mm, is provided in the second cavity.

In a preferred embodiment of the invention, the boot sole also includes at least two substantially cylindrical bosses projecting therefrom and directed downwardly. Concurrently, the upper surface(s) of the frame is also provided with cavities whose shapes correspond to the shapes of the bosses. The presence of these bosses and cavities is particularly advantageous, especially for the large sized frame and boots. Indeed, the fixing of a large boot on a large frame normally requires the two fixing elements to be much further spaced than about 180 mm.

In another preferred embodiment of the invention, the upper ends of the lateral flanges of the frame are slightly inclined surfaces, with respect to the upper surfaces, at an angle $\alpha$ having a value comprised between about 90° and 115°, more particularly comprised between about 98° and 102°. Concurrently, the surface of the sole is equipped with a longitudinal groove whose bottom is planar and whose edges are inclined with respect to the bottom of the groove at an angle $\beta$ comprised between about 90° and 115°, more particularly between about 98° and 102°. The lateral surfaces of the frame and the edges of the groove come in contact during the fixing of the boot on the frame.

The invention also relates to an interface element including one of the following elements: a walking outer sole, a front and rear end-piece for fixing on a ski, or integrated insert for fixing on a snowboard or any other gliding apparatus, on the one hand, and, projecting from its upper surface, a longitudinal block whose lateral surfaces are slightly inclined, and which includes at least two holes provided to receive two fixing elements located in the longitudinal plane of the interface element, and spaced from one another by a value E comprised between about 164 mm and 170 mm, more particularly equal to about 167 mm, on the other hand.

In another embodiment of the invention, a sole plate is inserted between the frame and the boot. This plate is fixed beneath the base of the boot; the sub-assembly thus constituted is then fixed to the frame by using the two aforementioned fixing elements.

In a first alternative of the preceding embodiment, the sole plate is made out of a material that is wear-resistant and promotes gliding.

In a second alternative of the same embodiment of the invention, the sole plate is an interface plate that makes it possible to fix on a frame according to the invention a boot whose front and rear lower surfaces are not coplanar.

Finally, in a third alternative of the same embodiment of the invention, the sole plate combines the two preceding limitations, i.e., this is a sole plate whose heel portion is thicker than the front portion and which includes, on its lower surface, gliding zones made of a material that is wear-resistant and promotes gliding.

BRIEF DESCRIPTION OF DRAWINGS

The invention will be better understood and other characteristics thereof will become apparent from the description that follows, with reference to the annexed schematic drawings showing, by way of non-limiting examples, a plurality of embodiments of the invention, and in which.

DETAILED DESCRIPTION OF THE INVENTION

Figure 1:
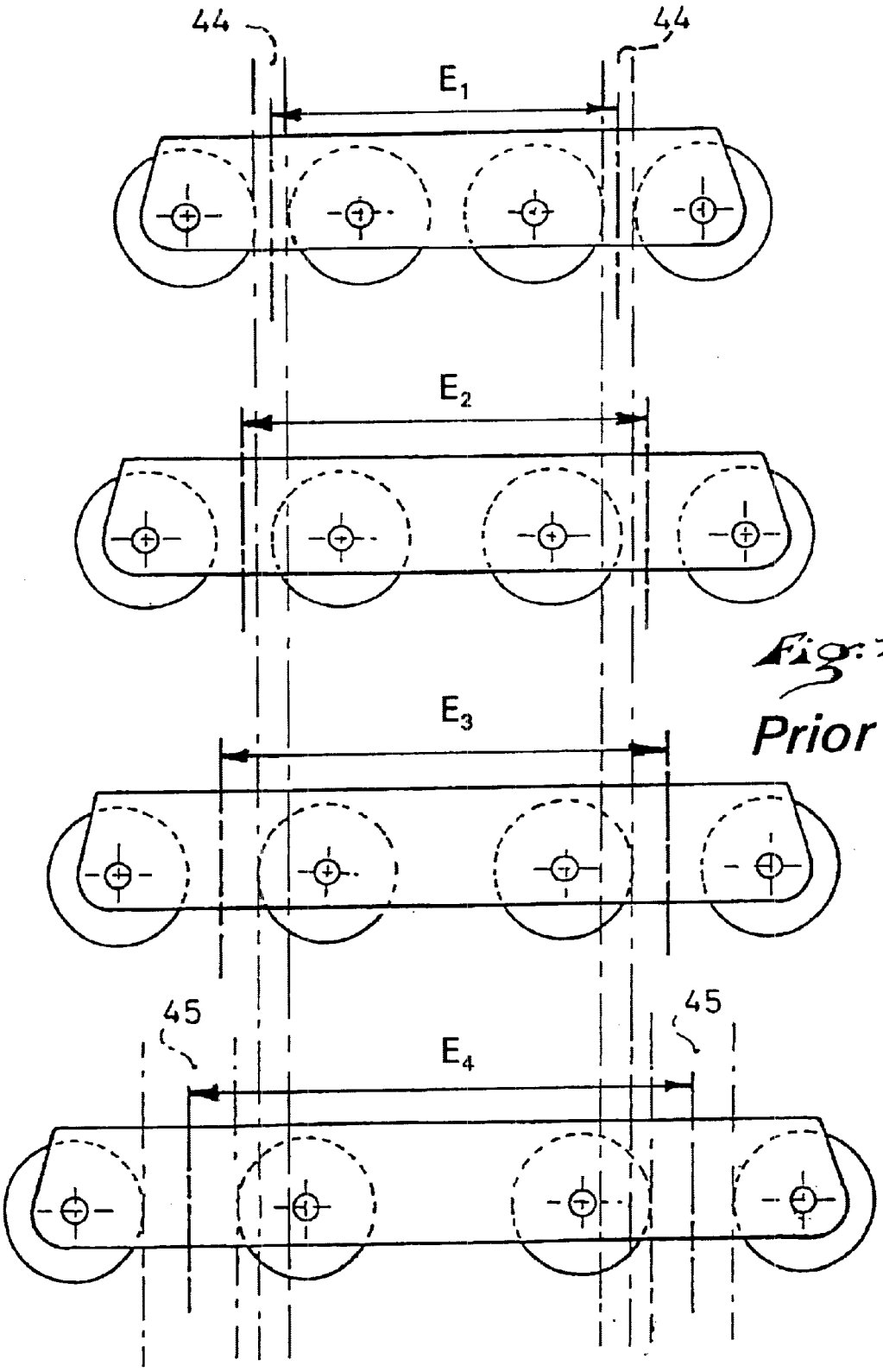
Fig. 1 Prior Art
FIG. 1 shows a line of frames for an in-line roller skate according to the prior art.

FIG. 1 schematically shows a line of frames adapted to the same model of a skate according to the prior art. It is known to provide the frame with various sizes so as to adapt it beneath boots of various sizes. Although European (mondopoint) sizes are referenced herein, the principles of the invention are clearly applicable to sizes common in the United States and elsewhere throughout the world.

Of course, each boot size should receive a frame size corresponding perfectly thereto, regardless of the size or the sizing standard used. In practice, for economical reasons, an attempt is made to limit the number of frames to be manufactured. The line of frames shown in FIG. 1 includes four frames whose length varies between 230 mm and 280 mm, and which must adapt to boots whose size varies from 240 mm to 310 mm.

The arrangement of the wheels 18 on the frame meets both technical and aesthetic requirements. The wheels must be arranged as uniformly as possible in order to better distribute the forces to be transmitted between the skater's foot and the ground, on the one hand; a uniform arrangement provides the skate with a more harmonious aspect, on the other hand. The frames shown in FIG. 1 are fixed to the boot by means of two screws which penetrate into two holes of the frame.

In the case where one wishes to have an easy access for mounting and dismounting the frame beneath the boot, it is necessary to position the screws (not shown) such that they can be accessed through the open space between two consecutive wheels 18. Under these conditions, for each respective frame size a different center distance value $E_1$, $E_2$, $E_3$, $E_4$ separating the two screws is provided. A value E common to all frame sizes cannot be found.

The example of the line of frames shown in FIG. 1 illustrates this impossibility. Indeed, the spaces 44 defined between the two front wheels and the two rear wheels of the shortest frame cannot correspond simultaneously to the same spaces 45 defined on the longest frame.

Figure 2:
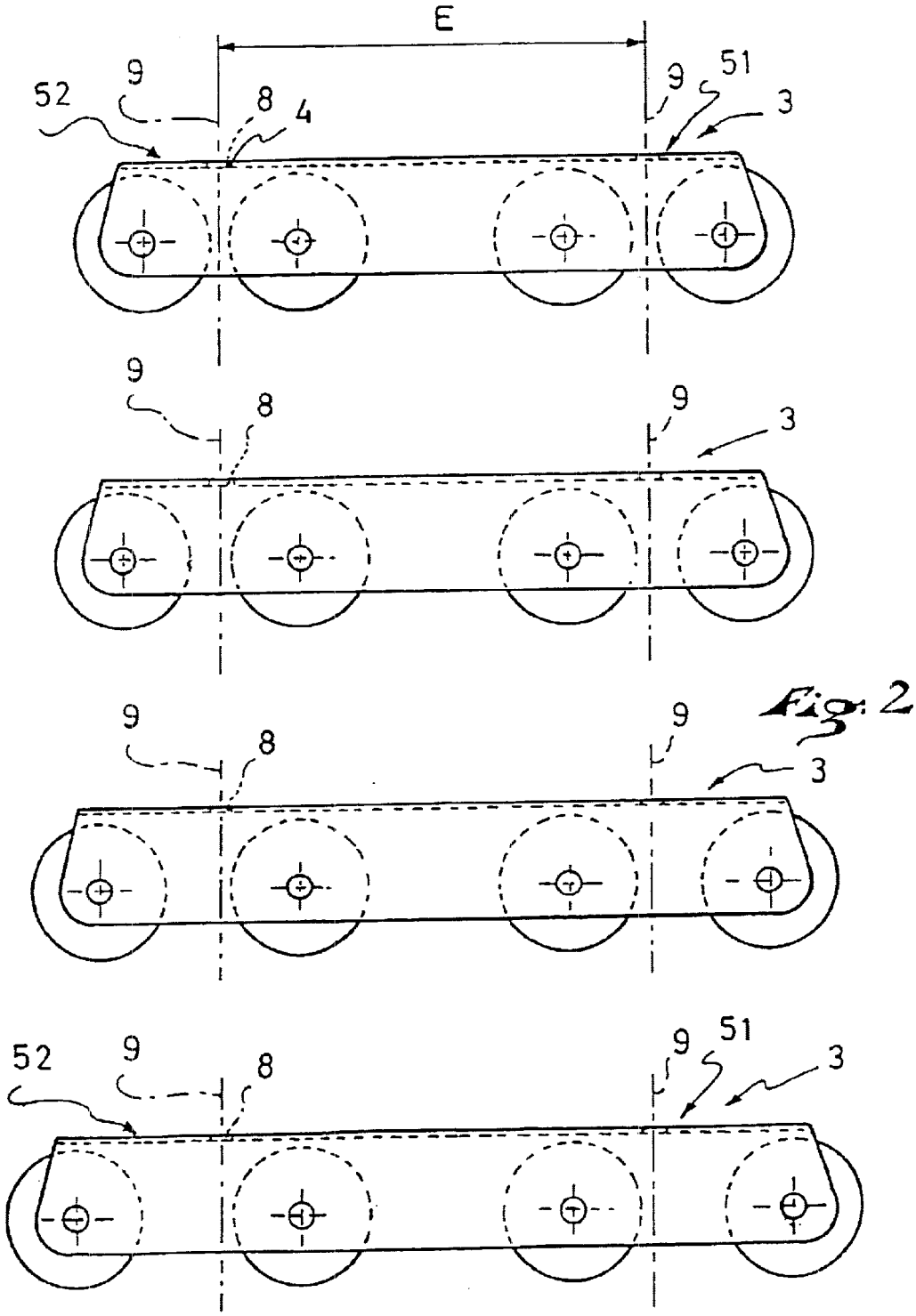
FIG. 2 shows a line of frames for an in-line roller skate in which each of the frames is a frame according to a first embodiment of the invention.

FIG. 2 shows a line of frames 3 of various sizes adapted to the same model of in-line roller skates. Each of these frames can be considered a different embodiment of the invention. The upper surfaces of all these frames, such as front upper surface 51 and rear upper surface 52, are planar surfaces. Two cylindrical holes having an axis 9 are provided on each of the frames 3 to receive the fixing elements. The distance between the cavities, called center distance E, is common to all the frames. This distance is comprised between about 164 mm and 170 mm.

It is noted that the distance between the axles of the two central wheels is also common to all the frames. The space demarcated by the two central wheels is thus always the same, regardless of the length of the frame. If this space were reserved for fixing a protective or gliding element such as a "grind block," it would suffice to develop and manufacture only one of these elements which can adapt to the entire line.

The mounting on these frames 3 of the wheels 18 having a slightly larger diameter, enabling the skater to reach higher speeds, does not fundamentally change the benefits drawn from a construction of a frame according to the invention, particularly for the longest frames.

Similarly, one can provide, for the mounting of at least one of the wheels, two inserts that are each maintained in one of the flanges of the frame 3, enabling the wheel to be fixed in various longitudinal positions while preserving the benefits drawn from a frame construction according to the invention.

Figure 3:
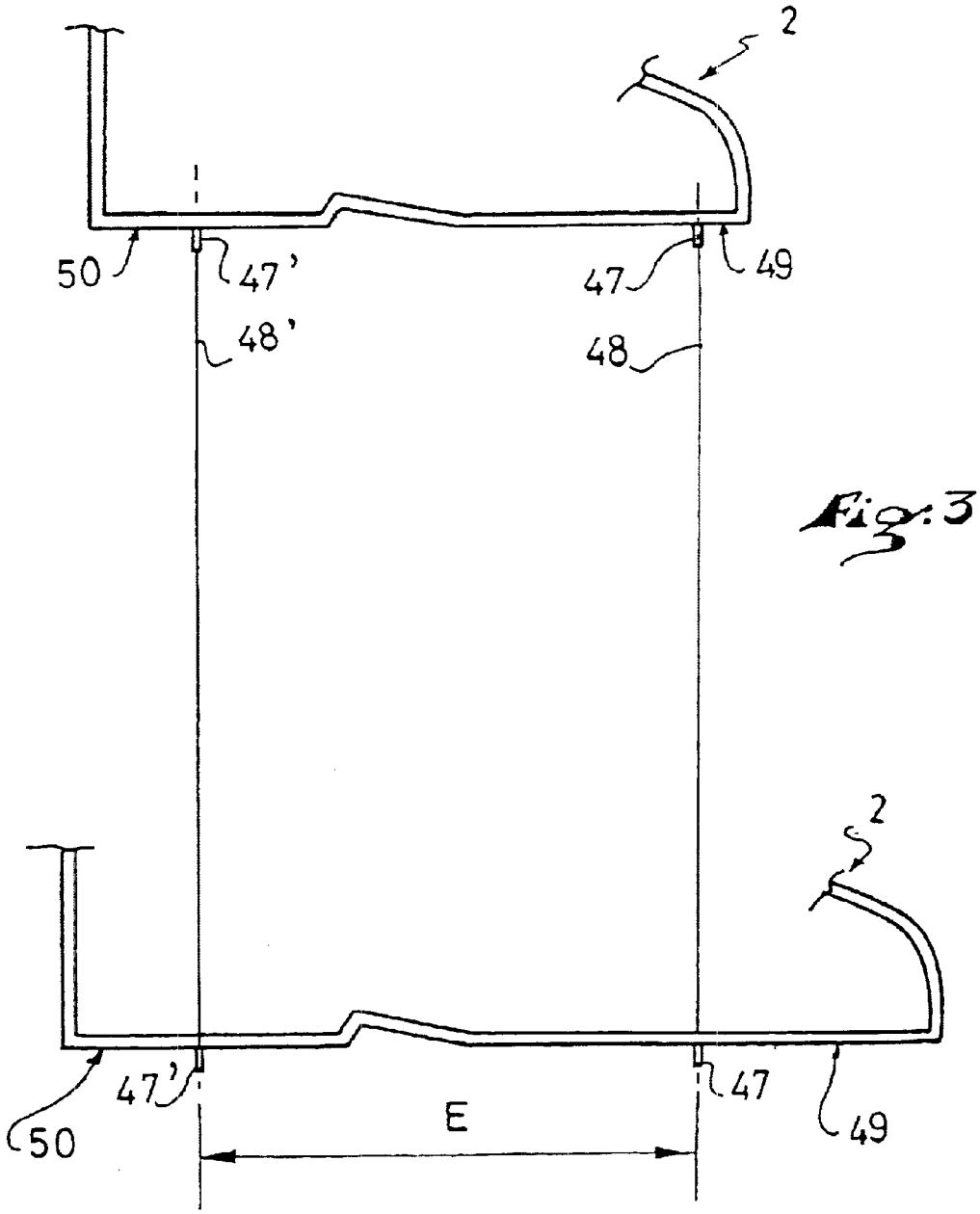
FIG. 3 shows two boots for a roller skate according to a second embodiment of the invention.

FIG. 3 schematically shows the two ends of a line of boots according to the invention, i.e., the smallest boot (about 240 mm) and the largest boot (about 310 mm). These boots are adapted to be mounted on frames, thus constituting the smallest and the largest skate in the line of the same model. The two boots 2 include two fixing elements oriented vertically, and which are at a distance of about 167 mm from each other. Advantageously, each of the frames of the line shown in FIG. 2 can be easily mounted beneath each of the boots of this line of boots, only the smallest and the largest sizes of which have been depicted.

In the case where the frame is absolutely symmetrical with respect to an equidistant transverse plane of the two axes 48, 48' of the front and rear fixing elements, only one effective position of the frame with respect to the boot is possible. Otherwise, the asymmetry of the frame makes it possible to define a front portion of the frame and a rear portion of the frame and two positions are then possible—the position where the front of the boot is on the front of the frame, and the position where it is on the rear of the frame. One can also provide "polarizing means" that prevent the second position (i.e., the reverse position of the frame).

Figure 4:
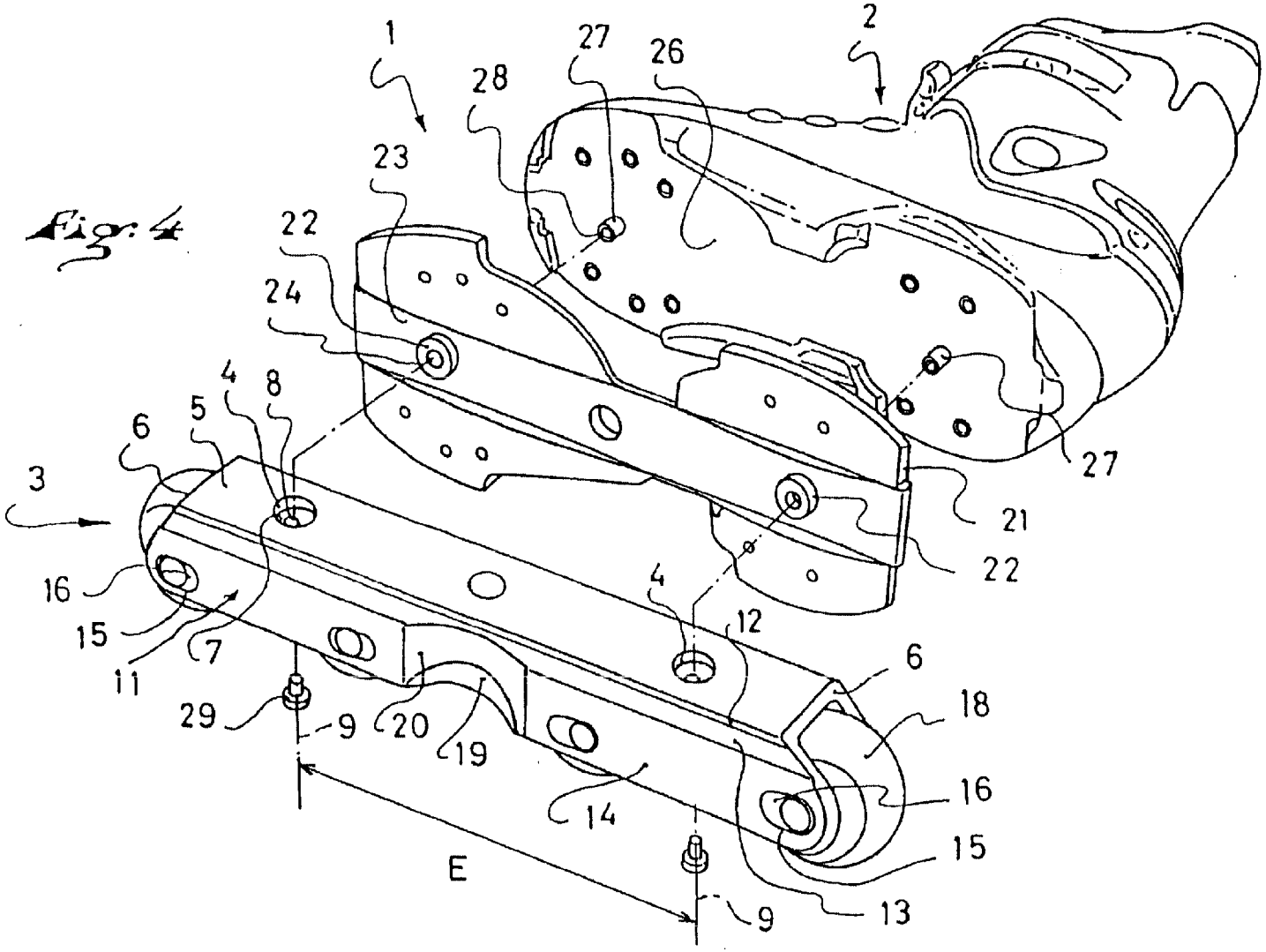
FIG. 4 shows a skate according to a third embodiment of the invention.

FIG. 4 is an exploded perspective view of one of the embodiments of the invention. This is an in-line roller skate 1 adapted for the "aggressive"-type skating, i.e., a practice that involves acrobatic figures performed during jumps or when the skate is gliding and/or grinding on surfaces provided for this purpose. Such a skate 1 is especially characterized in that gliding surfaces are provided therein. In general, there is a transverse gliding surface between the two central wheels and two longitudinal gliding surfaces beneath the sole of the footwear element on both sides of the frame.

This view shows the boot 2 adapted to receive the user's foot.

The upper surface 5 of the frame 3 is planar and horizontal. It extends continuously between the two longitudinal ends 6 of the frame 3. Two cavities 4 are provided in this upper surface 5. The bottom 7 of these cavities 4 is a circular planar surface oriented parallel to the plane of the upper surface 5.

The contour 10 of each of the cavities 4 is a truncated surface whose top angle is comprised between about 1° and 20°.

A hole 8 is arranged on the bottom 7 of each of the cavities 4. This hole 8 is preferably cylindrical along an axis 9 that is perpendicular to the surface of the bottom 7 of the cavity 4. The distance between the two axes 9, also called the center distance E, has a value equal to about 167 mm.

Such a skate proves to be very easy to use, especially in replacing the frame 3 or the sole plate 21. When the user wishes to modify the configuration of the skate and select a shorter frame, he/she only needs to loosen the two screws 29, separate the frame from the sub-assembly constituted by the boot and the sole plate 21, position the new frame, then tighten the screws 29 again. The presence of the bosses 22 and of the complementary cavities 4, as well as their dimension (diameter) which is greater than that of the fixing element (screw, e.g.), considerably facilitates the positioning of the frame 3 beneath the boot 2.

While remaining within the scope of this embodiment of the invention, one can also envision the hole not to have a circular cross-section but rather an oval or oblong cross-section, which facilitates a more tolerant fit of the frame on the boot.

Figure 5:
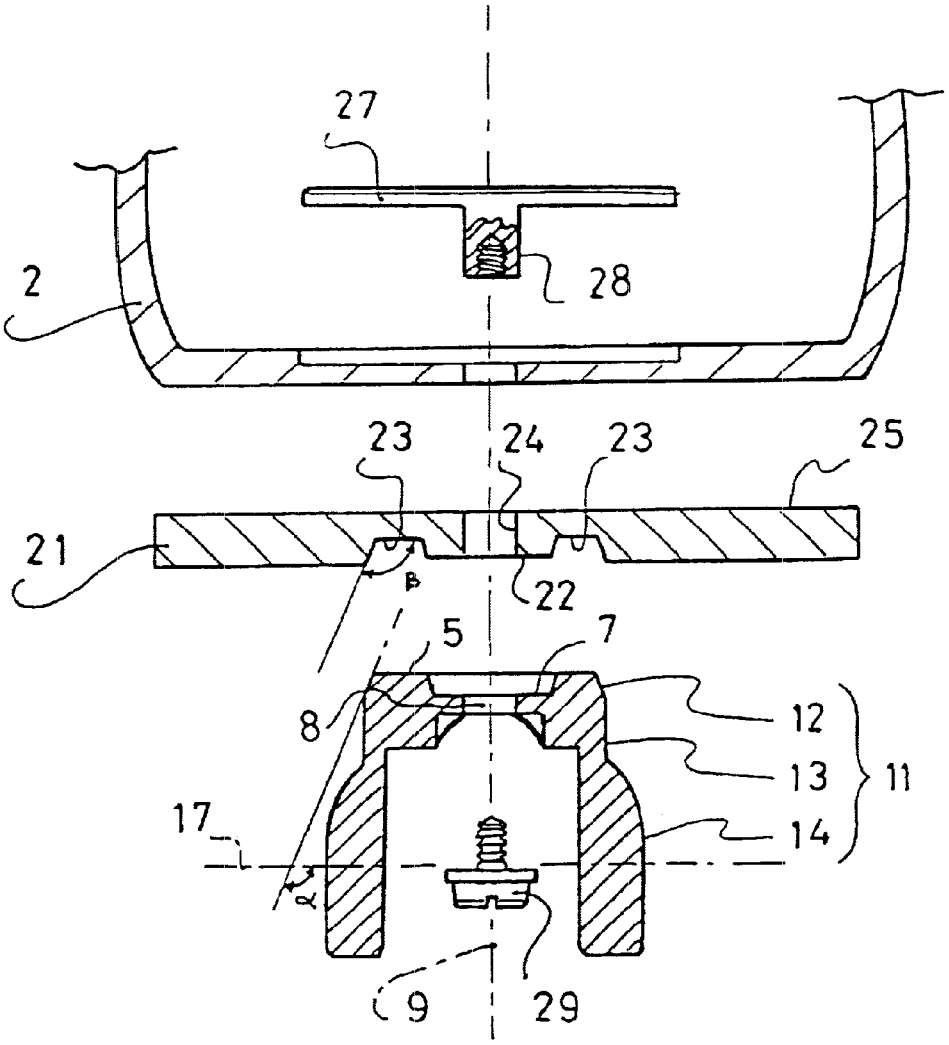
FIG. 5 shows a transverse cross-section of the skate shown in FIG. 4.

FIG. 5 shows a transverse cross-section of the skate shown in FIG. 4. In particular, it can be seen therein that the outer lateral flanges 11 of the frame 3 are made up, top down, of three sections. The first of these sections is adjacent the upper surface of the frame; it is called the lateral surface 12. Its height is about equal to the depths of the recesses. This lateral surface 12 extends longitudinally over the entire length of the frame 3; it forms, together with the upper surface, an angle $\alpha$ that is comprised between about 90° and 115°.

The lateral wall 13 of the frame extends in the extension of this lateral surface 12. The wall 13 is oriented along the longitudinal plane of the frame. Finally, the lower end of the outer lateral edges 11 of the frame 3 is constituted by a bulge 14. This bulge 14 has a thickness such that it completely overlaps the fixing elements of the wheels on the frame, thus offering an additional gliding surface.

Housings 15 are provided in the bulge 14. They receive a washer 16, having the same shape, which is perforated at one of its ends with a bore provided to receive the axle 17 for fixing the wheels 18.

Between the two central wheels 18, the frame has a notch that defines the lateral gliding direction. Given that the zone of the frame 3 that surrounds this notch is very biased during gliding, the bulge 14 can be replaced, at least in the central zone, by a wear plate 20.

The boot 2 has not been described here in detail. One may well choose a boot 2 of the rigid type, i.e., constituted of a rigid shell in which a flexible liner is inserted, or a boot of the flexible type, i.e., whose construction is similar to that of a sports boot, or finally, a boot of the hybrid type, i.e., either constituted of a partially rigid shell in which a liner is arranged, or constituted of a flexible upper 40 stiffened by the addition of a rigid reinforcement 41.

A sole plate 21 is inserted between the boot and the frame. This sole plate 21 includes two bosses 22 arranged at the bottom of a groove 23. The top of the boss is a circular planar surface.

In relation to the bottom of the groove, the boss 22 has a height that is about equal to the depth of the cavity 4. The edges of the groove are planar surfaces oriented longitudinally, and which form, together with the bottom of the groove, an angle $\beta$ about equal to the angle $\alpha$. The width of the bottom of the groove is about equal to the width of the upper surface of the frame. A recess 24 extends through the bosses 22. The upper surface 25 of the plate 21 is planar and comes in contact with the base of the footwear element 2 during assembly.

The assembly of the skate using an interface element according to a first embodiment of the invention is obtained as follows.

The sole plate 21 is fixed beneath the base 26 of the boot 2. This fixing can be done by any adequate means, such as screws, for example. The base 26 of the boot 2 is equipped with two threaded inserts 27. These inserts include a bush 28 whose outer diameter is such that it can be inserted with a play in the recess 24 of the plate 21. The frame 3 is then positioned beneath the plate 21 such that the bosses 22 penetrate into the cavities 4, and that the lateral surfaces 12 come in contact with the edges of the groove 23.

Finally, screws 29 are inserted in the holes to assemble the frame 3 to the boot 2.

The role of the sole plate 21 present in this embodiment is to provide the user with gliding surfaces made of a material that is neither the material of the boot, nor the material of the frame. Alternatively, even if the plate is made of the same material as the boot or the frame, the removability of this plate enables it to be replaced when it is worn out.

However, an embodiment of the invention is contemplated that does not provide such a plate, the bosses 22 as well as the edges of the groove 23 therein would then be provided directly beneath the base of the boot.

Figure 6:
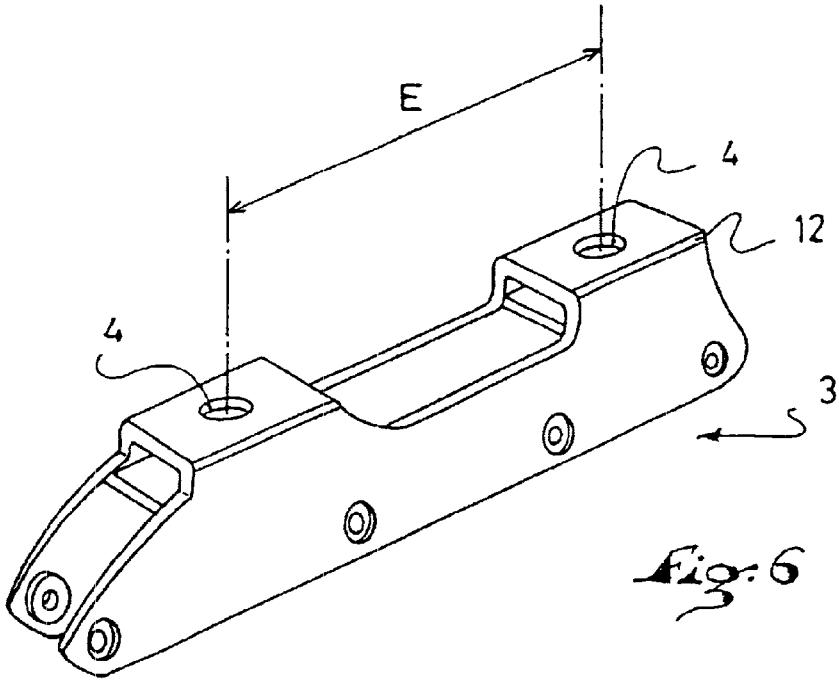
FIGS. 6 and 7 show two frames for in-line roller skates according to a fourth and fifth embodiment of the invention.

FIG. 6 shows a frame according to another embodiment of the invention. This is a frame made from a shaped element obtained by extrusion. The two upper surfaces thereof are flat and coplanar. A cylindrical cavity 4 is provided in each of these surfaces. A hole, such as hole 8, shown in FIG. 4, for example, adapted to receive the means for fixing the boot to the frame is located at the bottom of this cavity 4. The distance E separating the axes of the two holes is comprised between about 164 mm and 170 mm, more particularly equal to about 167 mm. Lateral surfaces, adjacent the upper surfaces and forming therewith an angle $\alpha$ comprised between about 90° and 115°, are arranged at the upper ends of the flanges of the frames.

Figure 7:
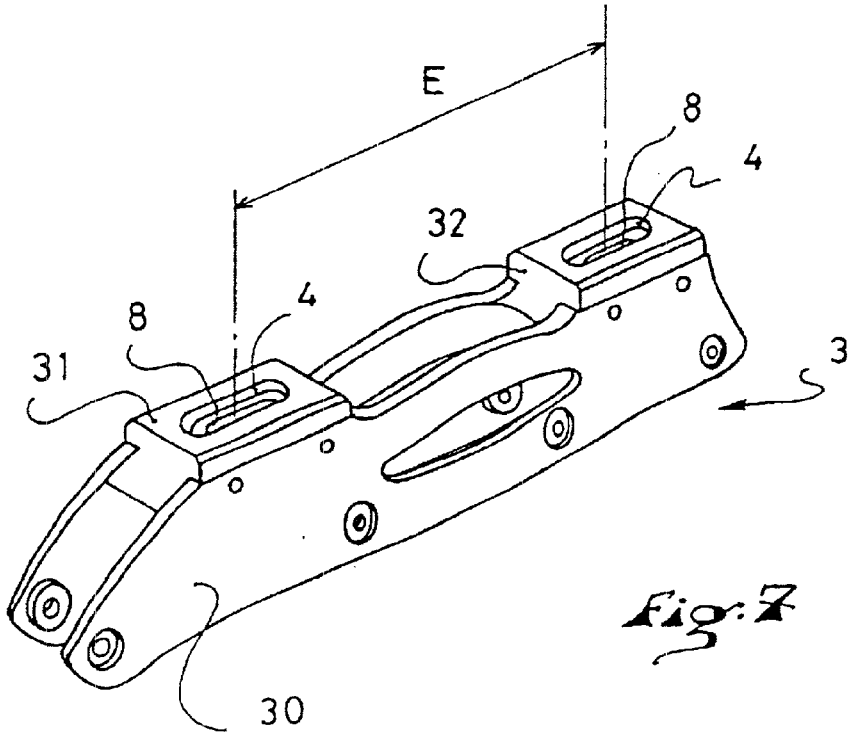

FIG. 7 shows a frame according to another embodiment of the invention. This is a frame 3 constituted of two flat flanges 30 connected to one another, a front bridge and a rear bridge. The upper and lower surfaces of the front and rear bridges are coplanar once they have been fixed to the flanges. Oblong cavities 4 are provided in the front and rear upper surfaces. Oblong holes 8 are bored at the bottom of the cavities 4, the distance between the median axes of these holes is comprised between about 164 mm and 170 mm, preferably equal to about 167 mm.

Figure 8:
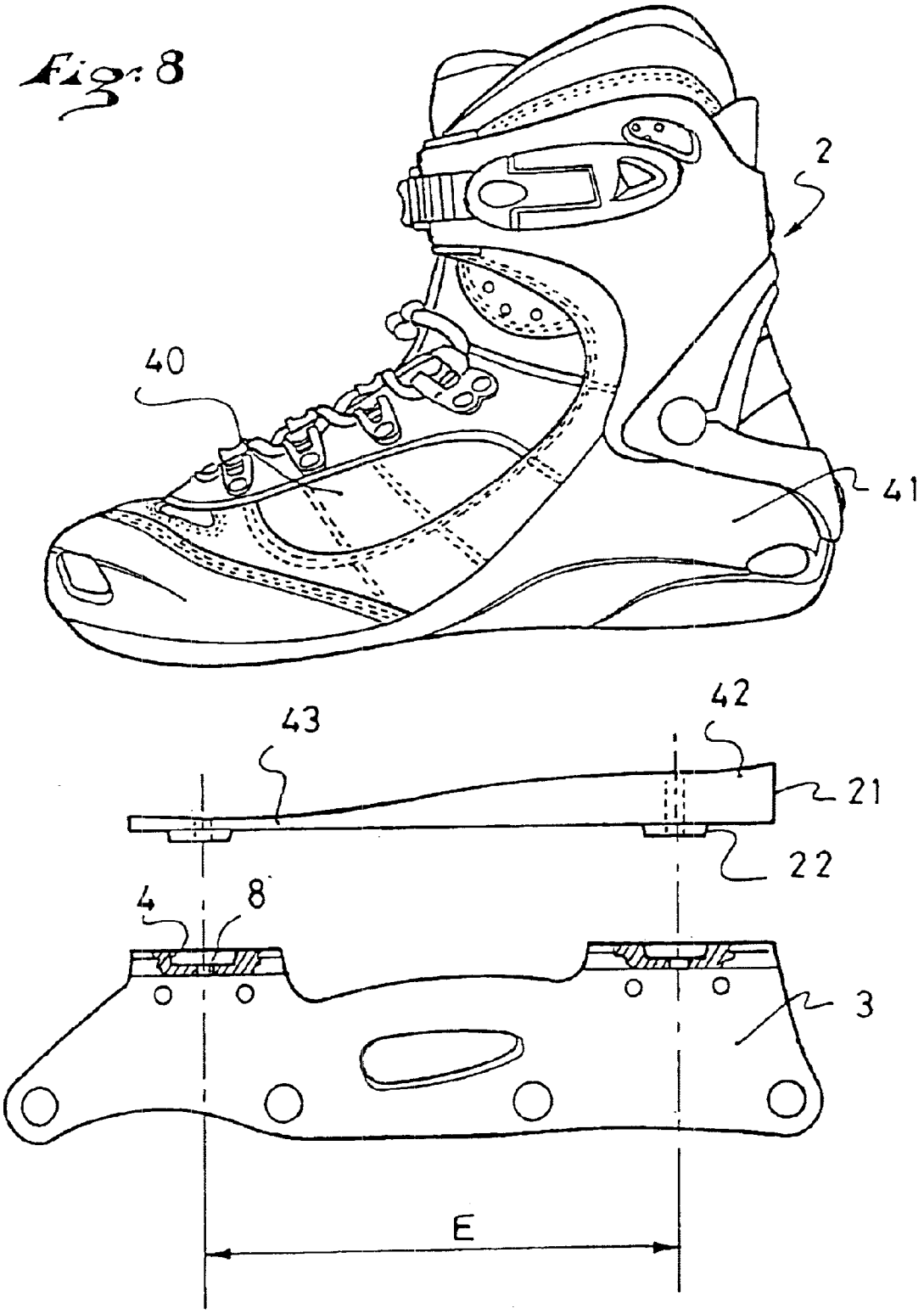
FIG. 8 shows a skate according to a sixth embodiment of the invention.

FIG. 8 shows a frame 3 and a sole plate 21 according to another embodiment of the invention. This is a frame whose construction is similar to the preceding frame, i.e., it is equipped with two flanges fixed on the front bridge and the rear bridge. Once it has been assembled, the frame 3 has coplanar front and rear upper surfaces on which substantially cylindrical cavities 4 are arranged. The bottom of the cavities 4 is bored with cylindrical holes 8 whose respective axes are distant by a value E comprised between about 164 mm and 170 mm, more particularly equal to about 167 mm.

A sole plate 21 is inserted between the boot 2 and the frame 3. The sole plate 21 includes two bosses 22 whose shape is complementary of the shape of the cavities 4 provided in the frame 3 and in the center of which a recess 24, provided to receive the means for fixing the boot to the frame, is bored. The rear portion 42 of the sole plate is thicker than the front portion 43 so as the provide the heel with the elevation necessary for roller skating. Fixing elements, such as screws, not shown in the figure, are inserted from within the boot in the holes of the boot, of the sole plate and of the frame. They are then tightened from beneath the frame.

Figure 9:
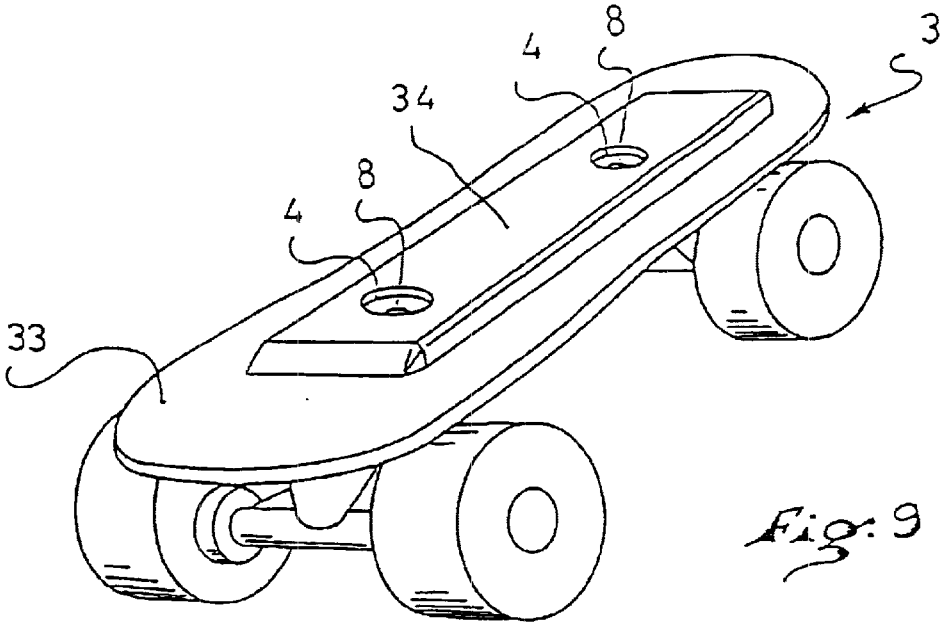
FIGS. 9 and 10 show frames according to a seventh and eighth embodiment of the invention.

FIG. 9 shows a frame of a quad-type roller skate, i.e., having four non-aligned wheels, according to another embodiment of the invention. The base plate of the frame 3 is equipped with a block 34 whose upper surface is planar and includes two substantially cylindrical cavities 4 at the bottom of which a cylindrical hole 8 is bored. The respective axes of the two cylindrical holes are at a distance of about 167 mm from one another. Therefore, one can fix such a frame beneath a boot/sole plate sub-assembly such as described in FIGS. 4 and 8, and benefit from the advantages of quad skates, such as greater ease in training and increased stability at stopping, for example.

Figure 10:
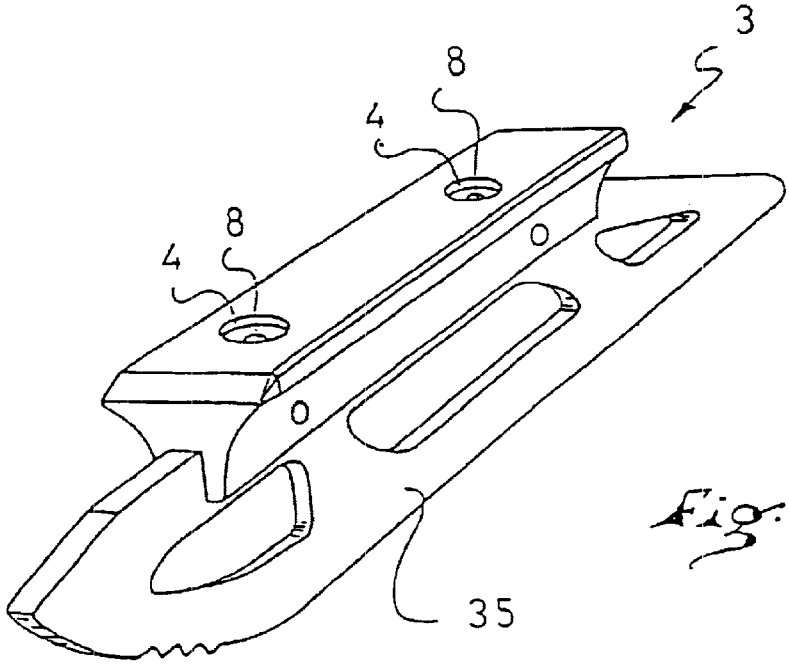

In the same way, with a skate boot such as described in FIGS. 4 and 8, one can ice skate upon fixing a blade support as shown in FIG. 10.

Figure 11:
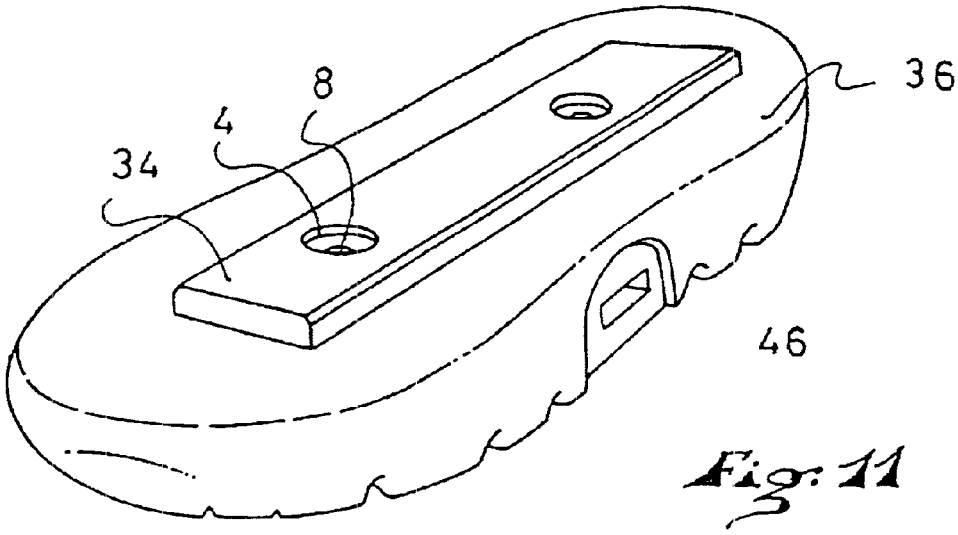
FIGS. 11 and 12 show interface elements according to a ninth and tenth embodiment of the invention.

The invention not only defines an interface system between a frame for a skate and a boot, but also provides interface elements that enable a user having a skate according to the invention to practice other sports, especially gliding sports, without having to put on another pair of boots. By way of non-limiting examples, FIG. 11 shows an interface element according to a ninth embodiment of the invention. This element is presented as a sole 36 for a snowboard boot on the upper portion of which is arranged a block 34 using the essential characteristics of the invention, i.e., holes 8 provided for elements for fixing the sole to a boot, the respective axes of the holes forming therebetween a distance comprised between about 164 mm and 170 mm, more particularly equal to about 167 mm. The sole 36 further includes one or more fixing inserts 46 that makes it possible to fix the footwear assembly, i.e., composed of the boot (not shown) and the sole, on a gliding apparatus such as a snowboard.

Figure 12:
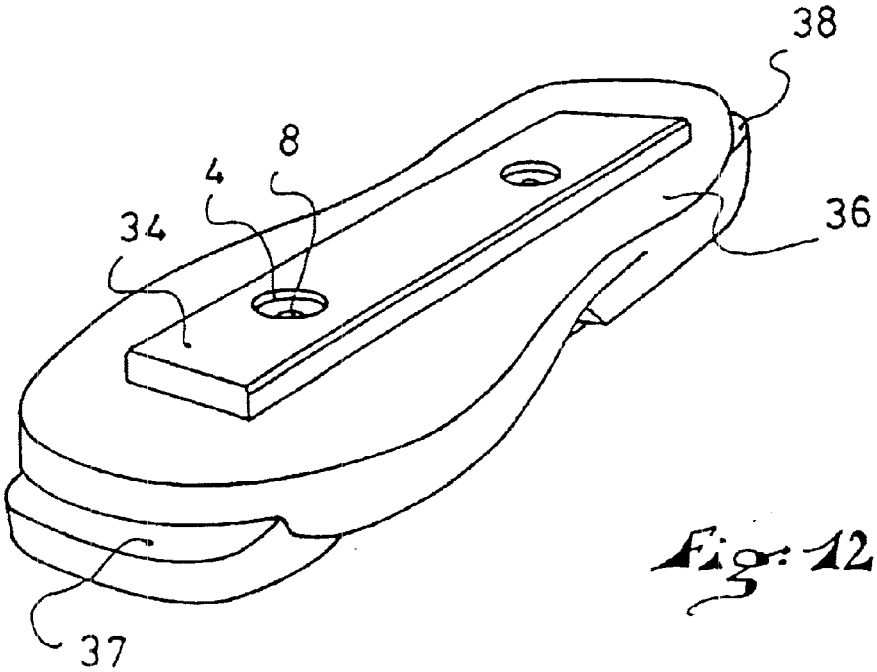

Similarly, FIG. 12 shows an interface element according to a tenth embodiment of the invention enabling the fixing of a boot, which is not shown but can be of the type described in FIG. 4, on an alpine ski. As in the preceding case, the interface element is in the form of a sole 36 having, on its upper surface, a block 34 using the essential characteristics of the invention. The sole is further equipped with front 37 and rear 38 end pieces adapted to cooperate with a front abutment and a heel-piece for fixing a ski, respectively.

The invention can be used in all fields where it is necessary to resolve the same problem, namely, fixing a boot on a sporting or leisure gear, according to a given standard, regardless of the length of the boot, while being compatible with a good transmission of the efforts generated during the practice of the sport.

NOMENCLATURE

1—Skate
2—Boot
3—Frame
4—Cavities
5—Upper surface
51—Front upper surface
52—Rear upper surface
6—Longitudinal end
7—Bottom of the cavity
8—Hole
9, 9'—Hole axes
10—Contour
11—Lateral flanks
12—Lateral surface
13—Lateral wall
14—Bulge
15—Housing
16—Washer
17—Axis
18—Wheel
19—Notch
21—Sole plate
22—Boss
23—Groove
24—Recess
25—Upper surface
26—Base
27—Threaded insert
28—Bush
29—Screw
30—Flange
31—Front bridge
32—Rear bridge
33—Base plate
34—Block
35—Blade
36—Interface element
37—Front end-piece
38—Rear end-piece
40—Flexible upper
41—Cradle
42—Rear portion
43—Front portion
44—Space between consecutive wheels of the short frame
45—Space between consecutive wheels of the long frame
46—Fixing insert
47, 47'—Fixing elements
48, 48'—Axes of the fixing elements
49—Front lower surface
50—Rear lower surface

What is claimed is:

1. A line of frames for roller skates, said line including at least a shortest frame and a longest frame, each said frame of the line including:

two parallel vertical flanges between which a plurality of in-line wheels can be positioned;

a planar front upper surface in the middle of which a first cavity is located, a first cylindrical hole having an axis perpendicular to said front upper surface provided in said first cavity;

a rear upper surface, coplanar with said front upper surface, in the middle of which a second cavity is located, a second cylindrical hole having an axis parallel to the axis of said first cylindrical hole and spaced therefrom by about 167 millimeters;

wherein, for each said frame of the line:

said plurality of in-line wheels are positioned between said two parallel vertical flanges; and said plurality of in-line wheels includes two central wheels, said two central wheels being spaced apart by the same distance within the line of frames.

2. A line of frames for roller skates according to claim 1, wherein:

said plurality of in-line wheels comprises at least four wheels, said four wheels including a forwardmost wheel, a rearwardmost wheel, and said two central wheels, said two central wheels consisting of two immediately successive wheels.

3. A line of roller skates, said line including a first pair of roller skates having a shortest frame and a second pair of roller skates having a longest frame, each said frame of line of roller skates including:

two parallel vertical flanges between which a plurality of in-line wheels are positioned;

a planar front upper surface in the middle of which a first cavity is located, a first cylindrical hole having an axis perpendicular to said front upper surface provided in said first cavity;

a rear upper surface, coplanar with said front upper surface, in the middle of which a second cavity is located, a second cylindrical hole having an axis parallel to the axis of said first cylindrical hole and spaced therefrom by between about 164 millimeters and 170 millimeters wherein, for each said frame of said roller skate of said line of roller skates:

said plurality of in-line wheels is positioned between said two parallel vertical flanges;

said plurality of in-line wheels includes two central wheels, said two central wheels being spaced apart by the same distance within the line of frames.

4. A line of roller skates according to claim 3, wherein:

said plurality of in-line wheels comprises at least four wheels, said four wheels including a forwardmost wheel, a rearwardmost wheel, and said two central wheels, said two central wheels consisting of two immediately successive wheels.

5. A line of frames for roller skates comprising:

a plurality of at least four sizes of frames, said plurality of frames including a shortest frame and a longest frame;

each said frame of said plurality of frames including:

two flanges between which a plurality of in-line wheels can be positioned;

a front upper surface extending between said two flanges, said front upper surface having a first cavity and a first hole within said first cavity, said first hole having an axis intersecting said front upper surface;

a rear upper surface extending between said two flanges, said rear upper surface having a second cavity and a second hole within said second cavity, said second hole having an axis intersecting said rear upper surface;

said axes of said first and second holes being substantially parallel and being spaced apart by a distance that varies within said plurality of frames by no greater than about six millimeters.

6. A line of frames for roller skates according to claim 5, wherein said distance by which said first and second holes of each frame of said plurality of frames are spaced apart is between about 164 and 170 millimeters.

7. A line of frames for roller skates according to claim 6, wherein said two frames within said plurality of frames have lengths as small as 230 millimeters and as large as 280 millimeters, respectively.

8. A line of roller skates comprising:

a plurality of at least four sizes of roller skates including a first roller skate having a shortest frame and a second roller skate having a longest frame;

each said frame of said plurality of at least four roller skates including:

two flanges between which a plurality of in-line wheels can be positioned;

a front upper surface extending between said two flanges, said front upper surface having a first hole and a first connector extending through said first hole connecting a boot to said frame, said first hole having an axis intersecting said front upper surface;

a rear upper surface extending between said two flanges, said rear upper surface having a second hole and a second connector extending through said second hole connecting the boot to said frame, said second hole having an axis intersecting said rear upper surface;

said axes of said first and second holes being spaced apart by a distance that varies within said plurality of skates by no greater than about six millimeters.

9. A line of roller skates according to claim 8, wherein said first and second connectors are first and second screws.

10. A line of roller skates according to claim 8, wherein said distance by which said first and second holes are spaced apart is between about 164 and 170 millimeters.

11. A line of roller skates according to claim 9, wherein said two frames within said plurality of frames have lengths as small as 230 millimeters and as large as 280 millimeters, respectively.

* * * * *